United States Patent [19]

Blass

[11] 4,028,704

[45] June 7, 1977

[54] BROADBAND FERRITE TRANSFORMER-FED WHIP ANTENNA

[75] Inventor: Judd Blass, Herzliah Petuach, Israel

[73] Assignee: Beam Systems Israel Ltd., Nof Yam, Israel

[22] Filed: Aug. 18, 1975

[21] Appl. No.: 605,338

[52] U.S. Cl. ..... 343/715; 343/860; 343/900

[51] Int. Cl.[2] ..... H01Q 1/32

[58] Field of Search ..... 343/715, 749, 750, 787, 343/860, 861, 900

[56] References Cited

UNITED STATES PATENTS

| | | | |
|---|---|---|---|
| 2,636,122 | 4/1953 | Hayes | 343/860 |
| 2,709,219 | 5/1955 | Schmidt | 343/860 |
| 3,267,476 | 8/1966 | Finke | 343/861 |
| 3,453,618 | 7/1969 | Ukmar et al. | 343/715 |
| 3,530,410 | 9/1970 | Parker | 343/822 |

*Primary Examiner*—Eli Lieberman
*Attorney, Agent, or Firm*—Ostrolenk, Faber, Gerb & Soffen

[57] ABSTRACT

The feed point of a whip antenna having a length less than one quarter-wavelength at the lowest frequency of operation is raised above a counterpoise ground plane by a short base sleeve. Gain over a 2.5:1 bandwidth of radio frequencies closely approaches the gain of a standard quarter-wavelength antenna without requiring use of power-dissipating resistance loading. A ferrite transformer at the whip antenna feedpoint is utilized to reduce the high anti-resonance impedance of the broadband whip antenna to the characteristic impedance of a coaxial cable transmission system and to minimize the VSWR thereof. The base sleeve raises the antenna resistance at the resonant frequency near the lower end of the bandwidth to make the transformer effective as an impedance matching element over the entire radio frequency band.

A pair of the whip antennas are axially aligned and electrically coupled in series to realize a broadband dipole having increased gain. A pair of dipoles are energized in phased relationship to realize even higher gain and directivity.

11 Claims, 5 Drawing Figures

BROADBAND FERRITE TRANSFORMER-FED WHIP ANTENNA

BACKGROUND OF THE INVENTION

The present invention relates to antennas and more particularly to a novel short length whip antenna configuration having increased gain over more than a 2.5:1 bandwidth without requiring broadband resistive loading or narrow band tuning.

It is well known that a quarter-wavelength antenna is a narrow bandwidth device, having increasing VSWR and decreasing gain as the transmission frequency is removed from the design frequency at which the antenna is exactly one quarter-wavelength long. A desirable vehicle-mounted radio-frequency antenna is characterized by operation over more than a 2.5:1 bandwidth with a substantially constant gain closely approaching that of the standard quarter-wavelength antenna. It is also desirable to have as short an antenna length as possible to minimize mechanical resonance and interference of a vehicle-mounted antenna with overhanging obstacles.

One whip antenna having a broadband, i.e., at least an octave, bandwidth is described in my copending U.S. Pat. application Ser. No. 557,836, filed Mar. 12, 1975, now U.S. Pat. No. 3,950,757. This broadband whip antenna utilizes and further requires resistive loading selectively positioned along the length of the whip antenna, which loading tends to reduce the amount of radio frequency energy radiated by the antenna, even though maintaining a low VSWR over the entire 2.5:1 bandwidth. It is desirable to eliminate the resistive loading and to further reduce the required whip length while increasing the antenna gain over more than a 2.5:1 radio-frequency bandwidth to be approximately equal to the gain of a narrow bandwidth quarter-wave antenna.

BRIEF SUMMARY OF THE INVENTION

In accordance with the invention, a broadband ferrite transformer coupled sleeve-fed whip antenna, realizing the above desirable goals, comprises an antenna whip section having a length less than one-quarter wavelength at the lowest frequency in at least an octave band of radio frequencies to be transmitted; a partially insulated base sleeve raising the feed point of the whip section above a ground plane whereby the distance between the ground plane and the free end of the whip section remote from the ground plane approaches a quarter-wavelength at the lowest frequency; and a ferrite transformer having a pair of primary windings and a secondary winding bifilar wound upon a single core, a first end of the secondary winding connected to the end of the whip section mounted to the base sleeve, a first end of the cross-coupled primary windings connected to the center conductor of a coaxial cable having a predetermined characteristic impedance, and the remaining ends of both primary and secondary windings connected to each other and to the outer conductor of the coaxial cable, to transform the high feed point impedance of the whip antenna to match the characteristic impedance of the coaxial cable.

In a preferred embodiment the antenna whip section has a length essentially equal to 0.46 wavelengths at the highest frequency in the band of radio frequencies to be transmitted. The insulating base sleeve has a length sufficient to place the free end of the whip antenna at a distance approximately 0.21 wavelengths, at the lowest frequency, above the ground plane on which the antenna and base combination are mounted. At the highest frequency in the radio frequency range, the whip antenna has a length of approximately 0.5 wavelengths, yielding reasonably constant gain over a bandwidth ratio of 2.5:1, with a power gain approximately 1.5dB better than a resistive-loaded, octave-bandwidth whip antenna. The normally high input impedance of the whip antenna, which might typically be 1000 ohms, is reduced by the ferrite transformer. The whip section is series resonant with the leakage inductance of the transformer at the low end of the bandwidth. A broadband two-pole matching circuit further reduces the normally 4.0:1 VSWR of the whip section and transformer to be less than 3.0:1.

A pair of whip antennas are axially aligned and coupled in electrical series opposed phase connection to form a driven dipole having increased gain over the 2.5:1 bandwidth.

A pair of driven dipoles are energized in phased relationship to realize a broadband array having even greater gain and directivity.

Accordingly, it is one object of the present invention to provide a broad bandwith whip antenna having a gain approximately equal to a standard quarter-wave antenna over more than octave bandwidth.

It is a further object of the present invention to provide a broad bandwidth whip antenna with a ferrite transformer for matching the feedpoint impedance of the whip antenna to the characteristic impedance of a coaxial cable and for reducing VSWR of the coaxial-cable fed antenna system.

It is a still further object of the present invention to provide an array of whip antennas having increased gain and directivity over at least a 2.5:1 bandwidth.

These and other objects of the invention will become apparent to one skilled in the art from the following description of the accompanying drawings.

DETAILED DESCRIPTION OF THE INVENTION

Figure 1:
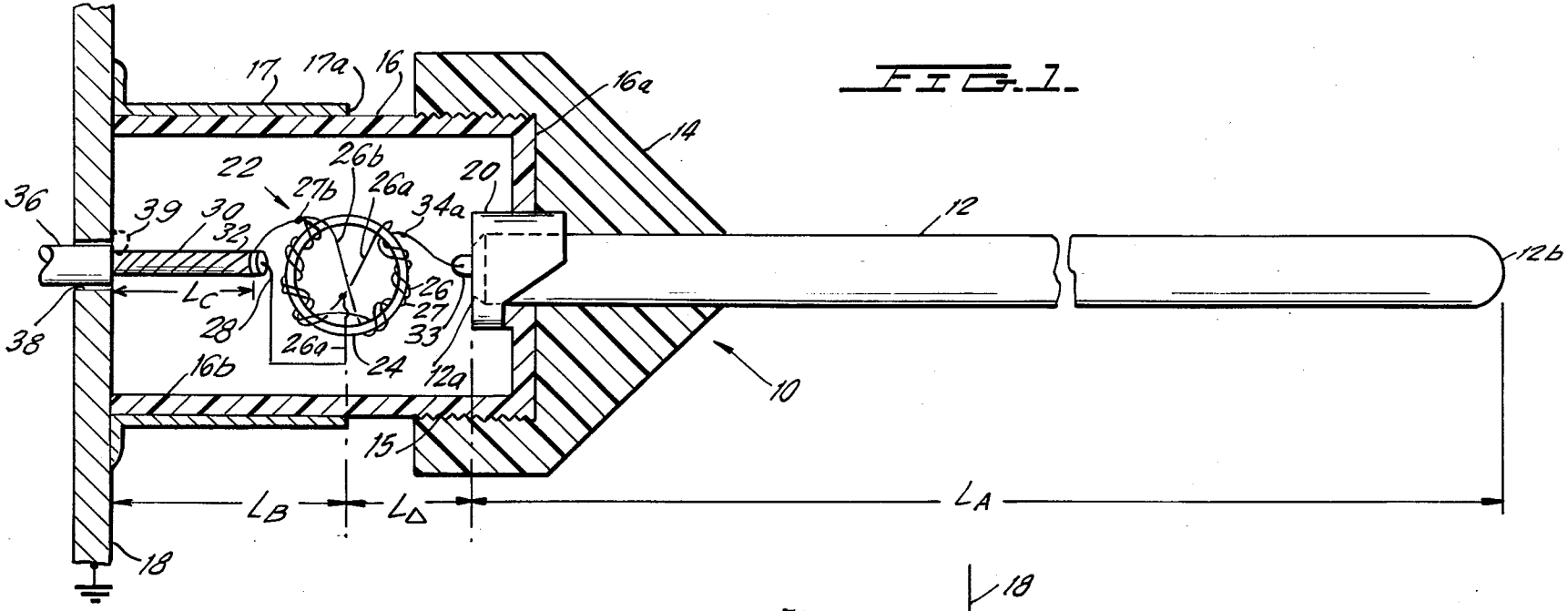
FIG. 1 is a cross-sectional view in side elevation of a broadband ferrite transformer-fed whip antenna in accordance with the invention.

Referring now to FIG. 1, broadband ferrite transformer-fed whip antenna 10 includes a conductive cylindrical whip section 12 having a tip-to-tip length $L_A$. A portion of the whip section periphery inwardly adjacent to a first whip section end 12a is encapsulated by a flange formation 14 of radio frequency insulating material. Flange 14 is adapted to mate with, and be retained by, suitable fastening means, such as cooperating screw threads 15 and the like, formed on the exterior periphery of a first end 16*a* of a generally cylindrical base sleeve 16, also formed of radio frequency insulating material. Base sleeve 16 and whip section 12 are fastened together in axial alignment with the common axis of rotation thereof usually being positioned in a vertical plane. In a preferred embodiment, the remaining base sleeve end 16*b* is closely received within the bore of a conductive sleeve 17 having an axial length $L_B$. The end of sleeve 17 farther from first whip section end 12*a* is fastened by suitable means to a ground plane 18, such as the metallic body of a vehicle. Metal sleeve 17 adds considerable mechanical strength to base sleeve 16 and simplifies attachment of antenna 10 to ground plane 18.

A hollow electrical contact sleeve 20 is centrally positioned in base sleeve end 16*a* to receive the whip section end 12*a* in firm mechanical and electrical connections therewith when flange formation 14 is engaged by base sleeve fastening means 15.

A matching transformer 22, enclosed within base sleeve 16 for protection against device environmental effects, includes a ferrite toroidal core 24 positioned with its center axis lying in the plane across the open conductive sleeve end 17*a* at a distance $L_B$ above ground plane 18 and as close to first whip section end 12*a* as is physically possible. A multi-turn primary winding 26 and a multi-turn secondary winding are wound about core 24 in known bifilar manner. A first primary winding end 26*a* is connected to the center conductor 28 of a high-impedance coaxial cable portion 30 having a length $L_C$ and substantially axially positioned in the interior volume of base sleeve 16. End 27*a* of a first secondary winding 27 is electrically connected to a lug 33 formed on electrical contact 20. The remaining primary and secondary winding ends 26*b* and 27*b*, respectively, are both electrically connected to the coaxial outer shield of coaxial cable 30. The opposite end of coaxial cable portion 30 is connected to an end of a standard coaxial cable 36 having a characteristic impedance *Zo* of 50 ohms, which cable 36 enters the interior volume of base sleeve 16 through an aperture 38 in ground plane 18. The end of outer shield 32 adjacent to plane 18 is electrically connected to ground either through the grounded shield of coaxial cable 36 or by a connection 39, shown in broken line in FIG. 1, to ground plane 18 at a point adjacent to the periphery of aperture 38.

In a preferred embodiment, the end of coaxial cable portion 30 nearest ground plane 18 has both the inner conductor 28 and outer shield 32 connected through an impedance matching circuit 40 and a quarter-wavelength coaxial matching section 42 (FIG. 2) having a characteristic impedance $Z_1$ and thence to standard coaxial cable 36, for a purpose more fully described hereinafter.

In a preferred embodiment, whip section 12 has a length $L_A = 0.185\ \lambda$ at the lowest frequency to be transmitted. The length of base sleeve 16 is selected to position the center of ferrite transformer 22 and the adjacent whip section feed-point at first end 12*a* at a distance $L_B = 0.025\lambda$ above ground plane 18. Thus, the total length from whip section free end 12*b* to ground plane 18 is $L_A + L_B = 0.21\lambda$, to closely approximate the length of a quarter-wave whip at the lowest frequency to be transmitted ($L\ \Delta$ being negligible).

I have found that the upper frequency limit for reasonable gain occurs when whip section 12 has a length $L_A = 0.465\lambda$. The ratio of this upper frequency limit to the lowest usable frequency is given by $BW = 0.465/0.185 \cong 2.5$; the ferrite transformer-fed whip antenna realizes in excess of an octave of usable frequency bandwidth.

At the highest frequency within the 2.5:1 bandwidth, the distance $L_B$ that the whip section feedpoint 12*a* is raised above the ground plane 18 is equal to $0.063\lambda$; the length from whip section free end 12*b* to ground plane 18 is approximately equal to one-half wavelength at this upper frequency.

In operation, the sleeve is just long enough at the low end of the band so that the overall length of approximately one quarter-wavelength can be realized without making the antenna whip section overly long at the highest frequency within the band.

Figure 2:
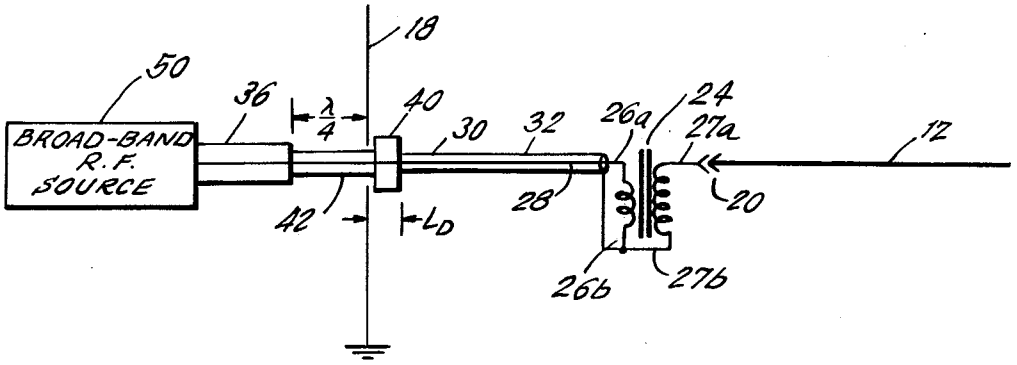
FIG. 2 is a schematic diagram of the antenna and of a ferrite matching transformer in accordance with the invention and useful in understanding the operation thereof.

Referring now to FIG. 2, wherein like reference numerals are utilized for like elements, the output energy of RF source 50, capable of transmitting at any single frequency contained within the greater than 2.5:1 bandwidth of whip antenna 10, is coupled via coaxial cables 36, 42 and 32 and impedance matching circuit 40 to appear across both sections of primary winding 26. This radio frequency energy is tranferred across the high efficiency tranformer 22 to secondary winding 27. In the bifilar-wound transformer 22, both sections of primary winding 26 are in parallel cross-coupled connection, while both sections of secondary winding 27 are in series additive connection, whereby a 1:4 impedance transformation is realized. Whip section 12 is referenced to coaxial cable outer conductor 32, thereby allowing ground plane 18 to act as a counterpoise for the antenna, forming an initial reflection to appear to double the length of the antenna and to cause a pseudo-current distribution over the entire tip-to-ground plane distance, $L_A$ and $L_B$. It should be recognized at this time that any counterpoise can be utilized as a proper ground plane and the antenna of the present invention can be used at a base station as well as on a vehicle.

The value of the radiation resistance $R_A$ for an ordinary base-fed whip antenna, without a sleeve, is known to vary from approximately 25 ohms when the whip antenna has a length of 0.2 λ, to about 800 ohms when the whip antenna is anti-resonant at a length of 0.4 λ for a resistance spread of 800/25 = 32 times. Sleeve 16 raises the feed point of the whip antenna 12 by a length $L_B$ above ground plane 18 to increase the feed point radiation resistance $R_A$ to about 50 ohms at the low frequency end of the greater than 2.5:1 bandwidth without changing the anti-resonant radiation resistance. Short base sleeve 16 causes a reduction in the radiation resistance spread of 800/50=16 times; lessening the radiation resistance spread by a factor of 2.

Broadband impedance transformer 22 produces a uniform 4:1 impedance reduction to yield a radiation resistance of 12.5 ohms at the low frequency end of the bandwidth and a radiation resistance of 200 ohms at anti-resonance, to provide a substantially constant 4:1 VSWR across the more than one octave bandwidth, relative to the 50 ohm characteristic impedance of input cable 36.

Figure 3:
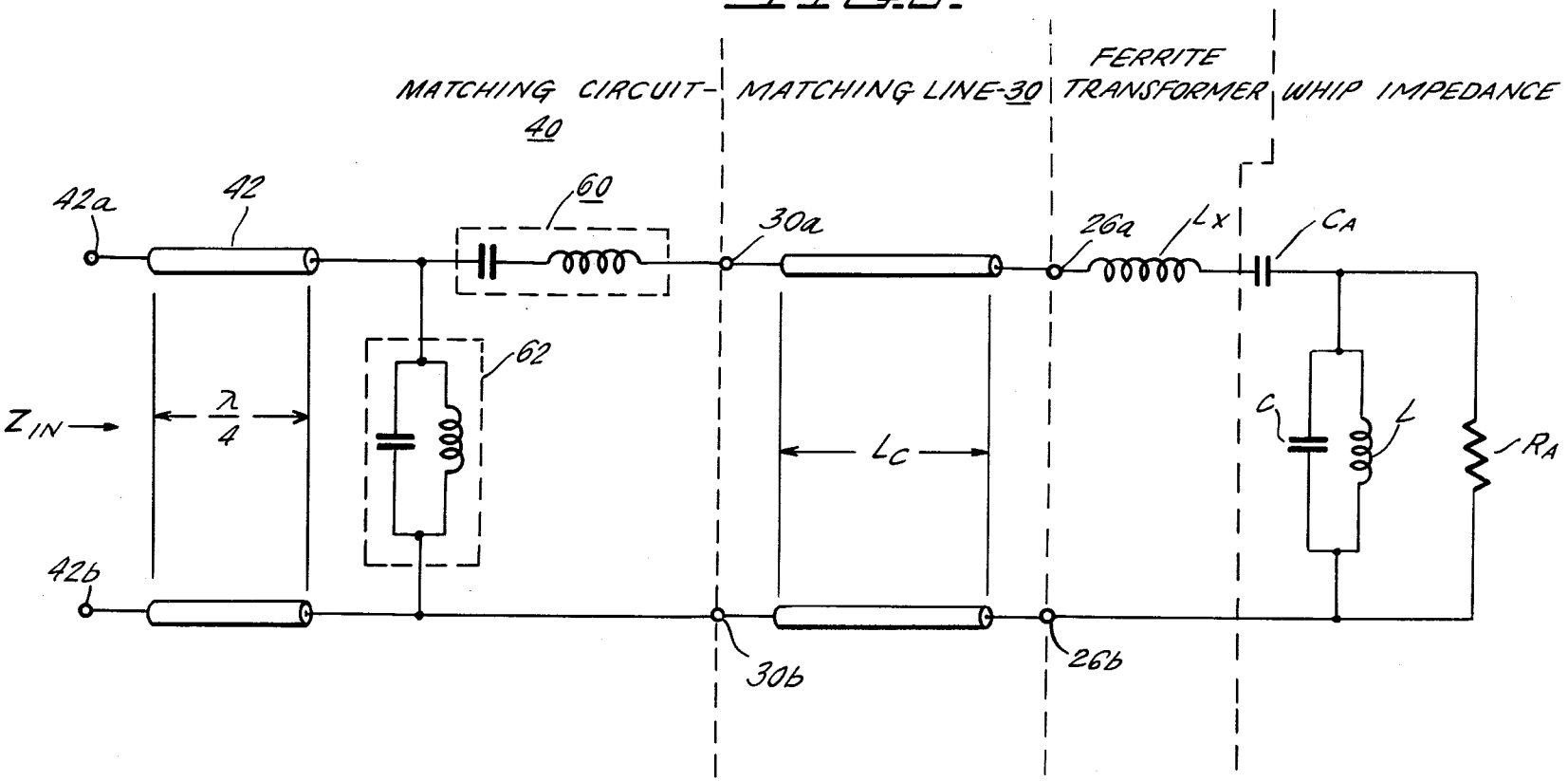
FIG. 3 is a schematic diagram illustrating the equivalent circuit of the broadband ferrite transformer-fed whip antenna and also useful in understanding the operation thereof.

Referring now to FIG. 3, the transformed antenna impedance appearing across primary winding terminals 26*a* and 26*b* of ferrite transformer 22 includes the antenna radiation resistance $R_A$ shunted by the anti-resonance impedance of an inductance L and a capacitance C, all in series with an antenna residual capacitance $C_A$ and a ferrite transformer leakage inductance $L_x$. Ferrite transformer 22 is designed to have a value of leakage conductance $L_x$ series-resonant with antenna residual capacitance $C_A$ at the low frequency end of the band. The entire whip and ferrite transformer impedance appears as a resistance between transformer primary terminals 26*a* and 26*b*, having a magnitude equal to the product of the substantially constant VSWR and the characteristic impedance of the standard coaxial transmission line 36, or approximately a 200 ohm radiation resistance across the more-than-octave band.

The approximately 4:1 VSWR is further reduced to a maximum VSWR of approximately 3:1 by a broadband matching circuit including coaxial cable portion 30 having a characteristic impedance of approximately 100 ohms. The length $L_c$ of coaxial cable portion 30 is maximized by reducing the length $L_D$ occupied by matching circuit 40 to the greatest extent possible. A preferred two-pole matching circuit 40 comprises a series resonator 60 and a shunt resonator 62 plus a quarter-wavelength transmission line tranformer 42. While matching circuit 40 is not essential to the basic operation of antenna 10, the reduction of the initial 4:1 VSWR attributable to antenna radiation resistance $R_A$ to a transformer radiation resistance $Z_{in}$ having a maximum VSWR less than 3:1 at matching circuit terminals 42*a* and 42*b* is desirable.

I have found that the use of a ferrite toroidal transformer 22 allows realization of a broadband antenna without requiring resistive loading of whip section 12. Additional gain of approximately 1.5dB. is realized with antenna 10 over the resistance-loaded broadband antenna, as a portion of the applied radio frequency energy is not dissipated in the resistive load.

Figure 4:
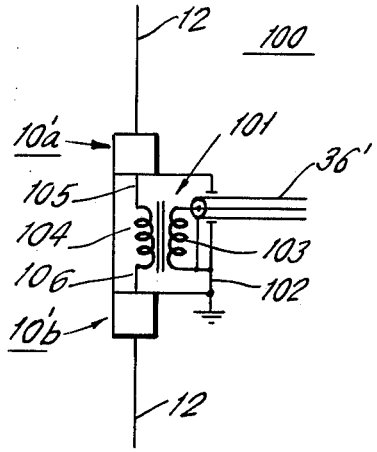
FIG. 4 is a schematic representation of an increased gain dipole array utilizing a pair of broadband whip antennas.

Additional gain over the at least 2.5:1 bandwidth is realized, in a preferred embodiment, by a dipole-type array 100 (see FIG. 4) comprised of first and second broadband whip antennas 10'*a* and 10'*b* respectively, having the longitudinal axes of whip sections 12, 12 aligned along a common line with the free ends thereof at opposed ends of the dipole array. A broadband impedance transformer 101 is enclosed within a grounded casing 102 serving as the ground plane and support for both whip antennas 10'*a* and 10'*b*. A primary winding 103 of impedance transformer 101 is coupled to input coaxial cable 36' and a secondary winding 104 is coupled at respective winding ends 105 and 106 to the input connections of respective whip antennas 10'*a* and 10'*b*.

Radio frequency current flowing into primary winding 103 induces current flow in opposed directions at winding ends 105 and 106 and hence a current flows into one whip antenna and flows out from the other whip antenna. Thus, the antenna current in whip antenna 10'*a* increases as the antenna current in whip 10'*b* decreases to effectively form a dipole of approximately one full wavelength at the maximum frequency of the at least 2.5:1 bandwidth. Antenna gain is increased to approximately +2dBi; a gain of approximately 3dB greater than the gain of a single broadband whip antenna 10.

The input impedance $Z_{in}$ of each whip antenna appears in series with secondary winding 104 to produce a secondary winding load impedance of $2 \cdot Z_{in}$. A 2:1 impedance transformation ratio between primary and secondary windings 103 and 104 is selected to transform this secondary winding load impedance to equal $Z_{in}$ at primary winding 103 and properly match the characteristic impedance of coaxial cable 36'.

Figure 5:
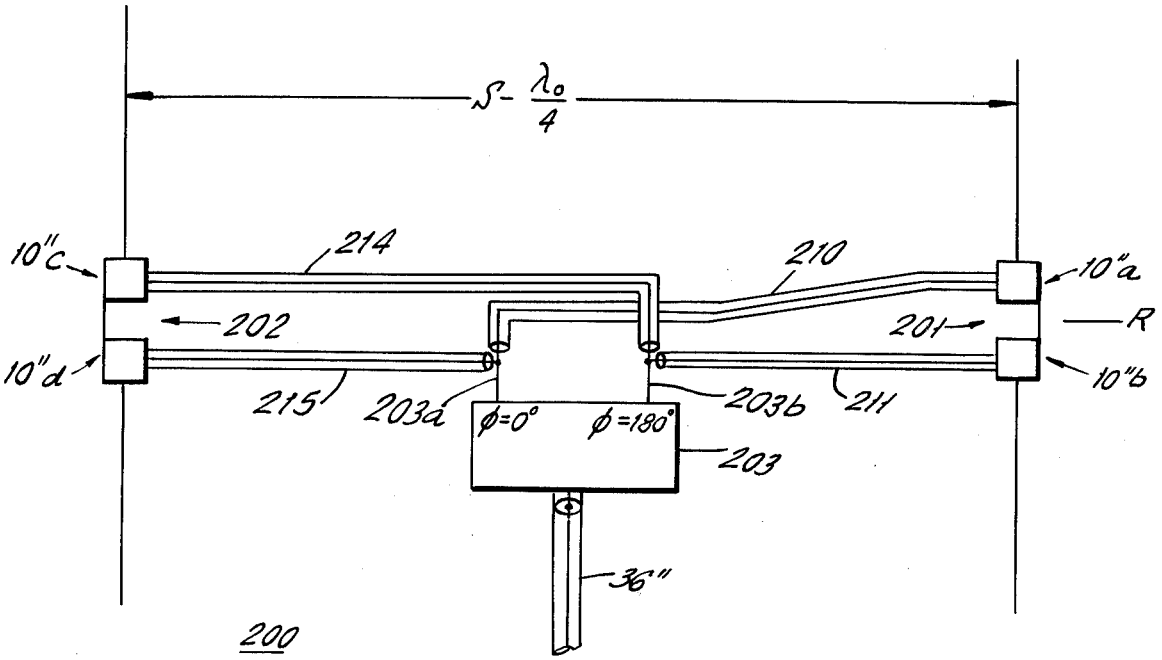
FIG. 5 is a schematic representation of a dual-dipole array utilizing four broadband whip antennas for even greater gain.

Referring now to FIG. 5, another whip antenna array 200 realizes even greater gain in addition to a directional radiation pattern. Array 200 is comprised of a first and a second dipole 201 and 202, respectively, having a spacing S therebetween equal to a quarter-wavelength at the center frequency of the at least 2.5:1 bandwidth ($S=\lambda_c/4$). Each dipole is comprised of a first whip antenna 10''*a* or 10''*c* and a second broadband whip antenna 10''*b* or 10''*d*, each having aligned whip section longitudinal axes. The common whip section axis of both dipoles are positioned in a single plane.

Radio frequency energy from coaxial cable 36'' is received by a hybrid power divider 203 having a 1:1 impedance transformation ratio and providing a pair of oppositely phased outputs 203*a* and 203*b*. Hybrid power divider 203 is internally terminated to maintain the opposed phase relationship at terminals 203*a* and 203*b* when each output terminal is loaded by the impedance of a pair of whip antennas in parallel connection.

In-phase output 203*a* and opposed-phase output 203*b* respectively energize first and second whip antennas 10''*a* and 10''*b*, respectively, of first dipole 201 via respective coaxial cables 210 and 211, each having an electrical length $L_0$. As each whip antenna of first dipole 201 is fed in opposite phase, a first dipole additional gain of +2dBi is realized in the same manner previously described for dipole array 100 hereinabove.

First whip antenna 10''*c* of second dipole 202 receives opposed-phase radio frequency energy from power divider output 203*b* via coaxial cable 214 and second whip antenna 10''*d* receives in-phase radio frequency energy from power divider output 203*a* via coaxial cable 215. Both coaxial cables 214 and 215 have equal lengths $L_1$ a quarter-wavelength longer than the length $L_0$ of coaxial cables 210 and 211; $L_1=L_0+\lambda_c/4$. Thus, the instantaneous antenna currents in first whip antennas 10''*a* or 10''*c* are of opposite phase to the instantaneous antenna current flowing in second whip antennas 10''*b* or 10''*d* respectively, and the composite antenna current flowing to second dipole 203 is in quadrature phase relationship with the composite antenna current flowing to first dipole 201 due to the delay of the extra quarter-wavelength of coaxial cables 214 and 215. This quadrature phasing combines with the quarter-wavelength spacing between the two dipoles to produce a cardioid-shaped antenna directivity pattern with an additional 3dB. gain in the direction of arrow R. Thus, twin dipole array 200 results in a total antenna gain of +5dBi.

There has just been described a novel broadband ferrite transformer sleeve-fed whip antenna having a less than one quarter-wavelength whip section raised above a counterpoise ground plane to increase the resonant frequency resistance and utilizing a ferrite toroidal transformer at the junction of whip section and base sleeve to reduce the normally high anti-resonant radiation resistance to match the characteristic impedance of a common coaxial cable while realizing an increased antenna gain as compared to a resistance-loaded broadband antenna. Several embodiments of antenna arrays utilizing multiple units of this novel broadband whip antennas to achieve greater gain and/or directivity have also been described.

The present invention has been described in connection with a preferred embodiment thereof; many variations and modifications will now become apparent to those skilled in the art. It is preferred, therefore, that the present invention not be limited by the specific disclosure herein but only by the appended claims.

What is claimed is:

1. A broadband whip antenna having a generally constant impedance across a radio frequency band of greater than 2.5:1, comprising:

a conductive ground plane;

a whip section comprising an elongated cylindrical conductor of a length approximately equal to 0.185 wavelengths at a lowest frequency in said frequency band and having a length to diameter ratio of the order of 200 or more;

means for positioning said whip section in a plane generally transverse to said ground plane with a first end of said whip section nearest to said ground plane being spaced a predetermined fraction of a wavelength from said ground plane at said lowest frequency to enhance the directivity characteristic of the antenna, said positioning means having a length sufficient to position a second end of said whip section approximately 0.21 wavelengths from said ground plane at said lower frequency;

a coaxial cable having a characteristic impedance between an inner conductor and an outer conductor thereof across said radio frequency band; and broadband transformer means positioned immediately adjacent said whip section first end and having a magnetic core for coupling said coaxial cable inner and outer conductors and said whip section end nearest said ground plane to transform the radiation resistance of said whip section to closely approximate said coaxial cable characteristic impedance, thereby reducing variation of the VSWR of the antenna as measured at the coaxial cable.

2. A broadband antenna as set forth in claim 1, wherein said broadband transformer means comprises a primary winding and a secondary winding wound about a ferrite core, said primary and secondary windings bifilar would with each other, said primary winding in electrical connection between said inner and outer coaxial cable conductors; and said secondary winding in electrical connection between said coaxial cable outer conductor and said first whip section end.

3. A broadband antenna as set forth in claim 2, wherein said ferrite transformer further comprises a toroidal core, said bifilar primary and secondary windings being wound about said core.

4. A broadband antenna as set forth in claim 1, wherein said whip section positioning means includes a base sleeve of radio frequency insulating material; means positioned in an end of said base sleeve farthest from said ground plane for electrically contacting said whip section first end; and means attached to another end of said base sleeve for mounting said base sleeve to said ground plane.

5. A broadband whip antenna as set forth in claim 4, wherein said whip section further includes means formed adjacent to said whip section first end for fastening and maintaining said whip section first end in contact with said electrical contacting means and said base sleeve.

6. A broadband antenna as set forth in claim 4, wherein said broadband impedance transformation means comprises a ferrite transformer positioned within said base sleeve adjacent to said whip contacting means.

7. A broadband antenna as set forth in claim 6, wherein said ferrite transformer has a primary winding and a secondary winding wound in bifilar fashion with each other; said primary winding electrically coupled between said inner and outer coaxial cable conductors; said secondary winding electrically coupled between said coaxial cable outer conductor and said contacting means.

8. A broadband whip antenna as set forth in claim 7, wherein said broadband impedance transformation means further comprises means coupled between said inner and outer coaxial cable conductors and said primary winding for matching the impedance across the primary winding to said coaxial cable characteristic impedance.

9. A broadband antenna as set forth in claim 8, wherein said impedance matching means comprises a section of another coaxial cable having a characteristic impedance greater than said coaxial cable and coupled between said coaxial cable and said primary winding.

10. A broadband antenna as set forth in claim 9, wherein said impedance matching means further comprises a two-pole matching circuit coupled to said another coaxial cable and a quarter-wavelength transmission line transformer coupled between said two-pole matching circuit and said coaxial cable.

11. A broadband whip antenna having a generally constant impedance across a radio frequency band of greater than 2.5:1, comprising:

a conductive ground plane;

a whip section comprising on elongated cylindrical conductor of a length less than one quarter wavelength at a lowest frequency in said frequency band and having a length to diameter ratio of the order of 200 or more;

means for positioning said whip section in a plane generally transverse to said ground plane with a first end of said whip section nearest to said ground plane being spaced a predetermined fraction of a wavelength from said ground plane at said lowest frequency to enhance the directivity characteristic of the antenna;

said whip section positioning means including: a base sleeve of radio frequency insulating material, means positioned in an end of said base sleeve furthest from said ground plane for electrically contacting said whip section first end, and means attached to another end of said base sleeve for mounting said base sleeve to said ground plane;

a coaxial cable having a characteristic impedance between an inner conductor and an outer conductor thereof across said radio frequency band; and broadband transformer means positioned immediately adjacent said whip section first end and having a magnetic core for coupling said coaxial cable inner and outer conductors and said whip section end nearest said ground plane to transform the radiation resistance of said whip section to closely approximate said coaxial cable characteristic impedance, thereby reducing variation of the VSWR of the antenna as measured at the coaxial cable;

said broadband impedance transformation means comprising a ferrite transformer positioned within said base sleeve adjacent to said whip contacting means, said ferrite transformer having a primary winding and a secondary winding wound in bifilar fashion with each other, said primary winding electrically coupled between said inner and outer coaxial cable conductors, said secondary winding electrically coupled between said coaxial cable outer conductor and said contacting means, means coupled between said inner and outer coaxial cable conductors and said primary winding for matching the impedance across said primary winding to said coaxial cable characteristic impedance.

* * * * *